US006156426A

United States Patent [19]

Lang et al.

[11] Patent Number: 6,156,426

[45] Date of Patent: Dec. 5, 2000

[54] FILLING YARN AND METHOD FOR PRODUCING IT FROM THERMALLY PROTECTED POLYAMIDE 6.6 FOR TIRE CORD FABRIC

[75] Inventors: Bruno Lang, Ballwil; Paul Schaffner, Kriens, both of Switzerland

[73] Assignee: Rhodia Filtec AG, Switzerland

[21] Appl. No.: 09/403,906

[22] PCT Filed: Apr. 28, 1998

[86] PCT No.: PCT/CH98/00170

§ 371 Date: Oct. 27, 1999

§ 102(e) Date: Oct. 27, 1999

[87] PCT Pub. No.: WO98/50612

PCT Pub. Date: Nov. 12, 1998

[30] Foreign Application Priority Data

May 6, 1997 [CH] Switzerland ..... 1060/97

[51] Int. Cl.[7] ..... D01F 6/00

[52] U.S. Cl. ..... 428/364; 428/370; 428/221; 428/395; 139/383 A; 28/246; 28/240

[58] Field of Search ..... 428/395, 370, 428/364, 222; 139/383 R; 28/246, 240, 271

[56] References Cited

U.S. PATENT DOCUMENTS 5,634,249 6/1997 Ballarati ..... 428/246
5,657,798 8/1997 Krummheuer et al. ..... 139/420 A

*Primary Examiner*—Newton Edwards
*Attorney, Agent, or Firm*—Michael J. Striker

[57] ABSTRACT

The invention relates to a filling yarn made of a thermally protected polyamide 66 multifilament for a tire cord fabric.

5 Claims, No Drawings

FILLING YARN AND METHOD FOR PRODUCING IT FROM THERMALLY PROTECTED POLYAMIDE 6.6 FOR TIRE CORD FABRIC

The present invention relates to a 100–400 dtex tyre cord fabric weft yarn comprising a heat-protected nylon-6,6 multifilament and to a process for producing a weft yarn.

Weft yarn for tyre cord fabric and a process for making it from polyester POY are known (WO-A-96/2391). The yarns produced from polyester POY filaments have very low thermal stability. Lower spinning speeds do not yield any improvement. The filament yarn turns brittle on the relaxation heater at 220° C., losing a large proportion of its strength and residual elongation at break.

It is an object of the present invention to provide a PA 66 tyre cord fabric weft yarn having high thermal stability, a defined reversibility limit, adequate tenacity and slip resistance and also a high ultimate tensile stress elongation.

It is a further object to provide a process for producing tyre cord weft yarns which, following impregnation, exhibit an ultimate tensile stress elongation which ensures spreading of the cord threads in tyre manufacture without weft thread breakages.

This object is achieved according to the invention when the base yarn combines the following features:

80% extension SLASE of 6 cN/tex to 12 cN/tex ultimate tensile stress elongation of 150 to 300% tenacity >14 cN/tex reversibility limit of 5 cN/tex to 10 cN/tex

160° C. thermal shrinkage force of 0.15 cN/tex to 0.8 cN/tex

160° C. free shrinkage >1%.

Such a yarn has the advantage of facilitating homogeneous warp thread distribution in tyre construction due to pronounced flow characteristics in the fabric. In addition, this yarn constitutes a single-component weft yarn which does not give rise to unpleasant and harmful dust in weaving, as is customary with the use of natural fibres. It is additionally intended to withstand high thermal stress during the impregnating step, to exhibit hardly any widthwise contraction and, in the construction of a tyre, to facilitate very homogeneous cord warp thread spreading and so be universally useful for tyre cord fabrics based on nylon, polyester and aramid.

At an extension of 80%, preferably 90–150%, a load of 6 cN/tex to 12 cN/tex, preferably 6–10 cN/tex, is advantageous. Loads higher than 12 cN/tex at the stated extension have the disadvantage of inhomogeneous warp thread distribution when the radial tyre expands on the tyre construction machine. Loads below 6 cN/tex at the stated extension lead, not only under uniform but also under local loads, for example in the course of storage of fabric bales, to irreversible weft thread stretching and so to inadequate stability with regard to warp thread parallelity. This gives rise to poor or unusable tyre carcasses.

An ultimate tensile stress elongation of <300%, preferably 180–280%, is advantageous. Ultimate tensile stress elongations of more than 300% lead to excessively high stretching under customary loads in the production of tyre cord fabrics; an ultimate tensile stress elongation of less than 150%, by contrast, leads to insufficient extensibility reserve, resulting in insufficient weft deformation or even weft yarn breakages in the fabric. In both cases, the resulting tyre carcasses are inhomogeneous and so the tyres which are manufactured therefrom are as well.

It is advantageous for the weft yarn to have a tenacity of at least 14 cN/tex in order that the peak stresses containing during the various processing steps cannot lead to weft yarn breakages.

A reversibility limit of 5 to 10 cN/tex is particularly advantageous. A reversibility limit of less than 5 cN/tex means that there is no way of ensuring dimensional stability on weft insertion or fabric width stability until processing into the tyre. If the reversibility limit is greater than 10 cN/tex, the force which results during the vulcanization step is not sufficient to spread the individual cord threads uniformly.

A thermal shrinkage force of 0.15 to 0.8 cN/tex has the advantage of virtually no widthwise contraction occurring during the impregnating step and hence of ensuring a homogeneous cord warp thread distribution, especially in the case of fabrics having weft yarn laid-in selvages, during this step as well; a thermal shrinkage force of greater than 0.8 cN/tex will, despite the forces applied by spreading rolls to the weft threads during the impregnating step, result in thread shortening, which jeopardizes the required homogeneity. This leads, especially at the fabric selvages, to undesirable warp thread compaction. In the case of thermal shrinkage forces of less than 0.15 cN/tex, the thermal stress on the carcass fabric during impregnation is sufficient to give rise to thread lengthening, which jeopardizes the parallelity of the warp threads.

According to the invention, it is not absolutely necessary for all the base yarn features to be within the claimed limits at one and the same time.

It is advantageous for the weft yarn to combine the following features following a tensionless hot air treatment at 235° C. for 5 min:

ultimate tensile stress elongation of greater than 80%

80% extension SLASE of 6 cN/tex to 14 cN/tex reversibility limit of 5 to 10 cN/tex no uncontrollable change in length due to the heat treatment.

Ultimate tensile stress elongations of greater than 80%, preferably greater than 110%, are advantageous. Ultimate tensile stress elongation of more than 110% for the impregnated fabric weft yarn have been found to be particularly useful, since this prevents any random breakage of individual weft threads, especially during the expanding of the tyre blanks on the tyre construction drum, during the process-based spreading of the carcass. Isolated weft thread breakages lead to nonuniform cord thread spacing in the carcass and so to inadequate tyre roundness.

The impregnated weft yarn has an 80% SLASE of less than 14 cN/tex, preferably less than 12 cN/tex. An 80% SLASE of more than 12 cN/tex increases, in the construction of a tyre, the risk of unlevel distribution of the warp threads as the carcass is expanded to the final tyre circumference. The impregnated yarn is conventionally RFL-dipped and then heat-set at temperatures of up to 245° C., preferably at 210–235° C. for 45–200 s.

The reversibility limit is less than 10 cN/tex, preferably less than 8 cN/tex, after the hot air treatment. This has the advantage that spreading forces that occur during vulcanization are sufficient to deform the warp threads so as to ensure uniform distribution of the carcass threads.

The starting material used for the feed yarn of the process of the present invention is a nylon-6,6 LOY. Instead of pure nylon-6,6 it is also possible to use a copolyamide at at least 85% by weight. Examples of suitable copolyamides are PA 6, PA 6,10 and aramid. The nylon-6,6 LOY has generally been drawn at spinning take-off speeds of less than 1800 m/min. The starting yarn is heat-protected with a copper additive at at least 30 ppm of Cu, preferably at 60–80 ppm of Cu.

In a particularly suitable one-stage production process starting from an LOY, nylon-6,6 LOY filaments heat-protected with at least 30 ppm of Cu are drawn between 10 and 200%, preferably between 40 and 150%, especially between 40 and 125, and then entangled by means of a compressed gas to at least 10 nodes/m, preferably at least 15 nodes/m. The process has the advantage of producing a compact filament assembly having a relatively rough and slip-resistant surface. The drawing of the LOY yarn can be effected cold or hot, with or without snugging pin.

In a varied process, the nylon LOY filaments are drawn between 10 and 200% in a first process step and then entangled, simultaneously or subsequently, to at least 10 nodes/m by means of a compressed gas and relaxed by between 0 and 30% at 150 to 235° C., preferably 200 to 225° C., in a second process step. This has the advantage of producing lower shrinkage values and lower LASEs.

In a further variant of the process, the weft yarn is additionally set, or afterdrawn, at a temperature between 150 and 235° C., especially between 180 and 225° C., by 0 to 10%. This has the advantage of providing for a further reduction in the shrinkage values and thus of making it possible to conform shrinkage properties to particular tyre construction process conditions.

The weft yarn is used as a base yarn and is particularly useful for tyre cord fabrics.

Methods of measurement:

Generally carried out after 24 h conditioning of the bobbins under standard conditions of 20±2° C. and 65±2% relative humidity.

Linear density:

Determination of the fineness of yarns and threads by the reel method (DIN 53 830 Part 1).

Tensile test:

Simple tensile test on yarns and threads in the conditioned state (DIN 53 834 Part 1)

clamped length 100 mm rate of extension 1000 mm/min.

Modulus:

Slope of the quasi linear part of the lower stress-strain curve.

Reversibility limit:

Equivalent to the elasticity limit→stress at which there is a transition from reversible to irreversible extension.

SLASE:

Specific load in cN/tex at stated extensions (2%, 5%, 10% and 80%).

Free thermal shrinkage: (residual or permanent)

Permanent change of length in % after a 15 min tensionless hot air treatment at 160° C. and a subsequent 15 min cooling down and conditioning in a standard atmosphere.

Effective shrinkage:

Change of length in % after 15 min treatment at 160° C. and 0.1 cN/tex pretensile force.

Effective shrinkage force:

Change of force in cN/tex of a sample firmly held at both ends with 0.1 cN/tex due to the 15 min hot air treatment at 160° C. The measurement is in each case carried out during the application of heat.

Embodiments of the invention will now be more particularly described by way of example.

EXAMPLES 1

A nylon-6,6 having a Cu content of 60 ppm was conventionally spun into a 519 dtex, 34 filament LOY having the properties recited in the following table. This starting material was then cold-drawn by 125% with a snugging pin at a take-off speed of 450 m/min (take-off godet in the drawing zone) and wound up with a linear density of 224 dtex. The detailed yarn properties can be seen in said aforementioned Table 1.

EXAMPLE 2

A nylon-6,6 having a Cu content of 30 ppm was conventionally spun into a 550 dtex, 17 filament LOY having the properties recited in the following table. This starting material was then drawn by 100% at 160° C. without a snugging pin at a take-off speed of 60 m/min (take-off godet in the drawing zone) and wound up with a linear density of 290 dtex. The detailed yarn properties can be seen in said aforementioned Table 1.

EXAMPLE 3

A nylon-6,6 having a Cu content of 60 ppm was conventionally spun into a 252 dtex, 34 filament LOY having the properties recited in the following table. This starting material was then cold-drawn by 40% with a snugging pin at a take-off speed of 120 m/min (take-off godet in the drawing zone) and wound up with a linear density of 190 dtex. The detailed yarn properties can be seen in said aforementioned Table 1.

EXAMPLE 4

A nylon-6,6 having a Cu content of 60 ppm was conventionally spun (similarly to Example 3) into a 252 dtex, 34 filament LOY having the properties recited in the following table. This starting material was cold-drawn by 50% with a snugging pin at a take-off speed of 143 m/min (take-off godet in the drawing zone). In a further continuous process step, a 25% relaxation was carried out at 220° C. by means of a contact heater 25 cm in length. The yarn linear density following these treatments was 215 dtex. The detailed yarn properties can be seen in the aforementioned Table 2.

EXAMPLE 5

A nylon-6,6 having a Cu content of 60 ppm was conventionally spun into a 273 dtex, 34 filament LOY having the properties recited in the following table. This starting material was then cold-drawn by 11% without a snugging pin at a take-off speed of 390 m/min (take-off godet in the drawing zone) and wound up with a linear density of 243 dtex. The detailed yarn properties can be seen in said aforementioned Table 2.

EXAMPLE 6

A nylon-6,6 having a Cu content of 60 ppm was conventionally spun (similarly to Example 3) into a 252 dtex, 34 filament LOY having the properties recited in the following table. This starting material was then, in a first step, cold-drawn by 50% with a snugging pin at a take-off speed of 135 m/min (take-off godet in the drawing zone). In second continuous process step, a 25% relaxation was carried out at 220° C. by means of a convection heater 65 cm in length. In the third continuous process step, the material was post-set at 210° C. on a contact heater 25 cm in length without further drawing. The yarn linear density resulting from these treatments was 214 dtex. The detailed yarn properties can be seen in the aforementioned Table 2.

EXAMPLE 7 (RELAXATION SERIES):

A nylon-6,6 having a Cu content of 60 ppm was conventionally spun (similarly to Example 1) into a 519 dtex, 34 filament LOY having the properties recited in the following table. This starting material (LOY) was then, in a first step, cold-drawn by 105% with a snugging pin at a take-off speed of 80 m/min (take-off godet in the drawing zone). In a second continuous process step, a convection heater 65 cm in length was used at 225° C. to produce three variants with 5%, 15% and 25% relaxation. The yarn linear densities resulting from these treatments were between 283–349 dtex. The detailed yarn properties can be seen in the aforementioned Table 3.

EXAMPLE 8 (ADDITION TO EXAMPLE 7)

The 25% relaxation variant described in Example 6 was additionally post-set in a third process step at 210° C. in a contact heater 25 cm in length without further drawing. The yarn linear density resulting from this treatment was 343 dtex. The detailed yarn properties can be seen in Table 3.

TABLE 1

Examples of the production of weft yarns for tire cord fabric

| | | Linear density dtex | UTS elongation % | Tenacity cN/tex | Specific modulus N/tex | Specific revers. cN/tex | SLASE 2% cN/tex | SLASE 5% cN/tex | SLASE 10% cN/tex | SLASE 80% cN/tex | Free TS (res) % | Shrinkage (eff.) % | Shrinkage force (eff.) cN/tex |
|---|---|---|---|---|---|---|---|---|---|---|---|---|---|
| Example 1: PA66, 34 filaments, 60 ppm of Cu, cold-drawn by 125% with snugging pin, in one stage | | | | | | | | | | | | | |
| A | Starting material (LOY) | 519 | 493 | 12.8 | 0.37 | 2.63 | 1.27 | 2.21 | 2.75 | 3.08 | 0.8 | 0.7 | 0.06 |
| B | 125.2% cold-drawn, with snugging pin drawing take-off 450 m/min | 224 | 271 | 18.9 | 0.51 | 5.54 | 1.74 | 3.35 | 4.91 | 7.19 | 6.3 | 8.5 | 0.45 |
| B1 | After 5 min at 235° C. | 235 | 262 | 16.4 | 0.32 | 6.43 | 1.85 | 3.24 | 4.43 | 9.20 | | | |
| | % change (based on B) | 4.9 | −3.3 | −13.2 | −36.5 | 16.1 | 6.1 | −3.2 | −9.7 | 28.0 | | | |
| Example 2: PA66, 17 filaments, 30 ppm of Cu, hot-drawn by 100% without snugging pin, in one stage | | | | | | | | | | | | | |
| A | Starting material (LOY) | 550 | 505 | 13.1 | 0.35 | 2.45 | 1.44 | 2.27 | 2.63 | 2.58 | 0.2 | −0.6 | 0.02 |
| B | After 100% hot drawing at 160° C. without snugging pin (60 m/min) | 290 | 210 | 22.8 | 0.54 | 6.59 | 1.93 | 3.90 | 6.45 | 9.55 | 12.5 | 16.7 | 0.69 |
| B1 | After 5 min at 235° C. | 327 | 212 | 15.5 | 0.50 | 7.99 | 2.14 | 3.79 | 5.66 | 10.64 | | | |
| | % change (based on B) | 12.8 | 1.2 | −31.7 | −8.8 | 21.3 | 10.9 | −2.7 | −12.3 | 11.4 | | | |
| Example 3: PA66, 34 filaments, 60 ppm of Cu, cold-drawn by 40% with snugging pin, in one stage | | | | | | | | | | | | | |
| A | Starting material (LOY) | 252 | 320 | 17.6 | 0.43 | 3.35 | 1.40 | 2.53 | 3.33 | 5.70 | −0.2 | 1.6 | 0.12 |
| B | After 40% cold drawing with snugging pin (120 m/min) | 190 | 203 | 22.3 | 0.57 | 8.00 | 1.85 | 3.89 | 6.62 | 10.44 | 10.7 | 14.7 | 0.74 |
| B1 | After 5 min at 235° C. | 214 | 206 | 16.7 | 0.55 | 6.63 | 2.08 | 3.64 | 5.18 | 10.89 | | | |
| | % change (based on B) | 12.9 | 1.5 | −25.2 | −3.3 | −17.1 | 12.6 | −6.5 | −21.8 | 4.3 | | | |

TABLE 2

| | | Linear density dtex | UTS elongation % | Tenacity cN/tex | Specific modulus N/tex | Specific revers. cN/tex | SLASE 2% cN/tex | SLASE 5% cN/tex | SLASE 10% cN/tex | SLASE 80% cN/tex | Free TS (res) % | Shrinkage (eff.) % | Shrinkage force (eff.) cN/tex |
|---|---|---|---|---|---|---|---|---|---|---|---|---|---|
| Example 4: PA66, 34 filaments, 60 ppm of Cu, 50% cold-drawing without snugging pin, 25% relaxation at 220° C., in two stages | | | | | | | | | | | | | |
| A | Starting material (LOY) | 252 | 320 | 17.6 | 0.43 | 3.35 | 1.40 | 2.53 | 3.33 | 5.70 | −0.2 | 1.6 | 0.12 |
| B | After 50% cold drawing and 25% relaxation (135 m/ | 215 | 189 | 14.6 | 0.36 | 6.11 | 1.76 | 3.18 | 4.52 | 8.66 | 3.8 | 6.2 | 0.47 |

TABLE 2-continued

| | | Linear density dtex | UTS elongation % | Tenacity cN/tex | Specific modulus N/tex | Specific revers. cN/tex | SLASE 2% cN/tex | SLASE 5% cN/tex | SLASE 10% cN/tex | SLASE 80% cN/tex | Free TS (res) % | Shrinkage (eff.) % | Shrinkage force (eff.) cN/tex |
|---|---|---|---|---|---|---|---|---|---|---|---|---|---|
| | min) | | | | | | | | | | | | |
| B1 | After 5 min at 235° C. | 226 | 169 | 13.3 | 0.36 | 6.74 | 1.96 | 3.35 | 4.71 | 10.00 | | | |
| | % change (based on B) | 5.1 | −10.6 | −8.5 | 2.7 | 10.3 | 11.7 | 5.1 | 4.2 | 15.5 | | | |
| Example 5: PA66, 34 filaments, 60 ppm of Cu, 11% cold-drawing without snugging pin, in one stage | | | | | | | | | | | | | |
| A | Starting material (LOY) | 273 | 315 | 16.6 | 0.41 | 3.09 | 1.29 | 2.33 | 3.07 | 5.26 | 0.1 | 1.7 | 0.11 |
| B | 11% cold-drawn without snugging pin drawing take-off 390 m/min | 243 | 278 | 16.8 | 0.38 | 5.40 | 1.73 | 3.17 | 4.07 | 6.13 | 3.2 | 4.5 | 0.29 |
| B1 | After 5 min at 235° C. | 254 | 178 | 15.0 | 0.40 | 6.10 | 1.77 | 3.23 | 4.41 | 7.36 | | | |
| | % change (based on B) | 4.5 | −36.0 | −10.9 | 3.9 | 13.0 | 2.5 | 1.9 | 8.2 | 20.1 | | | |
| Example 6: PA66, 34 filaments, 60 ppm of Cu, 50% cold-drawing without snugging pin, 25% relaxation at 220° C., post-setting 210° C., afterdrawing 0%, in 3 stages | | | | | | | | | | | | | |
| A | Starting material (LOY) | 252 | 320 | 17.6 | 0.43 | 3.35 | 1.40 | 2.53 | 3.33 | 5.70 | −0.2 | 1.6 | 0.12 |
| B | After 50% cold drawing, 25% relaxation and 0% post-setting, 210° C. (135 m/min) | 214 | 190 | 15.0 | 0.34 | 5.62 | 1.75 | 3.25 | 4.28 | 8.70 | 2.6 | 5.3 | 0.37 |
| B1 | After 5 min at 235° C. | 216 | 174 | 14.6 | 0.39 | 6.66 | 1.96 | 3.37 | 4.82 | 10.73 | | | |
| | % change (based on B) | 1.1 | −8.6 | −2.9 | 15.4 | 18.5 | 12.5 | 3.6 | 12.6 | 23.3 | | | |

TABLE 3

| | | Linear density dtex | UTS elongation % | Tenacity cN/tex | Specific modulus N/tex | Specific revers. cN/tex | SLASE 2% cN/tex | SLASE 5% cN/tex | SLASE 10% cN/tex | SLASE 80% cN/tex | Free TS (res) % | Shrinkage (eff.) % | Shrinkage force (eff.) cN/tex |
|---|---|---|---|---|---|---|---|---|---|---|---|---|---|
| Example 7: Relaxation series; PA66, 34 filaments, 60 ppm of Cu, 100% cold-drawing, with snugging pin, 0–25% relaxation at 225° C., in two stages | | | | | | | | | | | | | |
| A | Starting material (LOY) | 519 | 493 | 12.8 | 0.37 | 2.63 | 1.27 | 2.21 | 2.75 | 3.08 | 0.8 | 0.7 | 0.06 |
| B | After 100% cold drawing with snugging pin (80 m/min) | 277 | 195 | 23.2 | 0.74 | 7.51 | 2.67 | 5.46 | 7.99 | 10.99 | 13.2 | 18.1 | 0.72 |
| B1 | After 5 min at 235° C. | 343 | 235 | 16.2 | 0.42 | 6.97 | 2.07 | 3.56 | 5.10 | 9.85 | | | |
| | % change (based on B) | 24.0 | 20.4 | −30.3 | −43.9 | −7.3 | −22.6 | −34.8 | −36.1 | −10.3 | | | |
| | After additional relaxation at 225° C. | | | | | | | | | | | | |
| C | After 100% cold drawing, 5% relaxation | 283 | 202 | 22.3 | 0.53 | 7.05 | 2.08 | 4.06 | 6.18 | 11.10 | 7.2 | 8.56 | 0.49 |
| C1 | After 5 min at 235° C. | 312 | 197 | 16.4 | 0.37 | 7.84 | 2.08 | 3.69 | 5.45 | 11.63 | | | |
| | % change (based on C) | 10.2 | −2.6 | −26.7 | −29.7 | 11.2 | −0.1 | −9.3 | −11.9 | 4.9 | | | |
| D | After 100% cold drawing, 15% relaxation | 310 | 198 | 17.8 | 0.44 | 6.29 | 1.90 | 3.58 | 5.10 | 9.39 | 5.7 | 6.3 | 0.39 |
| D1 | After 5 min at 235° C. | 338 | 212 | 14.5 | 0.46 | 6.15 | 1.95 | 3.52 | 5.06 | 10.12 | | | |
| | % change (based on D) | 9.0 | 6.9 | −18.4 | 4.4 | −2.2 | 2.6 | −1.7 | −0.7 | 7.8 | | | |

TABLE 3-continued

| | | Linear density dtex | UTS elongation % | Tenacity cN/tex | Specific modulus N/tex | Specific revers. cN/tex | SLASE 2% cN/tex | SLASE 5% cN/tex | SLASE 10% cN/tex | SLASE 80% cN/tex | Free TS (res) % | Shrinkage (eff.) % | Shrinkage force (eff.) cN/tex |
|---|---|---|---|---|---|---|---|---|---|---|---|---|---|
| E | After 100% cold-drawing, 25% relaxation | 349 | 270 | 17.8 | 0.31 | 5.08 | 1.58 | 2.87 | 3.87 | 7.31 | 2.8 | 3.7 | 0.22 |
| E1 | After 5 min at 235° C. | 361 | 243 | 14.3 | 0.34 | 5.92 | 1.91 | 3.27 | 4.65 | 9.00 | | | |
| | % change (based on E1) | 3.6 | −9.9 | −19.9 | 8.8 | 16.5 | 21.1 | 13.9 | 20.2 | 23.1 | | | |
| Example 8: Similarly to variant E of Example 7, but with additional setting stage at 210° C., without afterdrawing, in three stages | | | | | | | | | | | | | |
| F | After 100% cold-drawing, 25% relaxation, 0% post-setting, 210° C. | 343 | 261 | 16.9 | 0.35 | 5.24 | 1.72 | 2.97 | 4.11 | 7.81 | 1.4 | 2.3 | 0.19 |
| F1 | After 5 min at 235° C. | 346 | 272 | 16.8 | 0.43 | 6.15 | 1.99 | 3.79 | 5.29 | 9.57 | | | |
| | % change (based on F) | 0.9 | 4.1 | −0.5 | 22.8 | 17.3 | 15.9 | 27.3 | 28.7 | 22.4 | | | |

What is claimed is:

1. A 100–400 dtex tyre cord fabric weft yarn comprising a heat-protected nylon-6,6 multifilament, characterized in that the base yarn combines the following features:

80% extension SLASE of 6 cN/tex to 12 cN/tex ultimate tensile stress elongation of 150 to 300% tenacity >14 cN/tex reversibility limit of 5 cN/tex to 10 cN/tex

160° C. thermal shrinkage force of 0.15 cN/tex to 0.8 cN/tex

160° C. free shrinkage >1%.

2. A weft yarn according to claim 1, characterized in that the weft yarn combines the following features following a tensionless hot air treatment at 235° C. for 5 min:

ultimate tensile stress elongation of greater than 80%

80% extension SLASE of 6 cN/tex to 14 cN/tex reversibility limit of less than 10 cN/tex no increase in length due to the heat treatment.

3. A process for producing a 100–400 dtex tyre cord fabric weft yarn comprising a heat-protected nylon-6,6 multifilament, characterized in that nylon LOY filaments are drawn between 10 and 200% and entangled to at least 10 nodes/m by means of a compressed gas.

4. A process according to claim 3, characterized in that the nylon LOY filaments are drawn between 10 and 200% in a first process step and then entangled to at least 10 nodes/m by means of a compressed gas and relaxed by between 0 and 30% at 150 to 235° C. in a second process step.

5. A process according to claim 4, characterized in that the nylon LOY filaments are additionally set (afterdrawn) between 0 and 10% at 180–230° C.

* * * * *